United States Patent [19]

Lang et al.

[11] Patent Number: 4,903,613

[45] Date of Patent: Feb. 27, 1990

[54] UNDERCARRIAGE FOR A TRACK-BOUND VEHICLE

[75] Inventors: Hans-Peter Lang, Donauwörth; Thilo von Madeyski, Hanover, both of Fed. Rep. of Germany

[73] Assignee: Messerschmitt-Bölkow-Blohm GmbH, Munich, Fed. Rep. of Germany

[21] Appl. No.: 222,156

[22] Filed: Jul. 21, 1988

[30] Foreign Application Priority Data

Aug. 1, 1987 [DE] Fed. Rep. of Germany ..... 3725574

[51] Int. Cl.[4] ..... B61F 5/38

[52] U.S. Cl. ..... 105/167; 105/182.1

[58] Field of Search ..... 105/168, 167, 165, 157.1, 105/182.1, 199.1

[56] References Cited

U.S. PATENT DOCUMENTS

| | | | |
|---|---|---|---|
| 424,089 | 3/1890 | Bosdevex | 105/168 |
| 4,067,261 | 1/1978 | Scheffel | 105/157.1 X |
| 4,170,179 | 10/1979 | Vogel | 105/168 |
| 4,480,553 | 11/1984 | Scheffel | 105/167 |
| 4,519,329 | 5/1985 | Vacher | 105/168 |
| 4,648,326 | 3/1987 | Jackson | 105/168 |
| 4,660,476 | 4/1987 | Franz | 105/168 |
| 4,676,172 | 6/1987 | Bullock | 105/168 |
| 4,735,149 | 4/1988 | Scheffel et al. | 105/167 X |

FOREIGN PATENT DOCUMENTS

| | | | |
|---|---|---|---|
| 2356267 | 5/1974 | Fed. Rep. of Germany . | |
| 2624719 | 11/1977 | Fed. Rep. of Germany | 105/168 |
| 3232289 | 3/1983 | Fed. Rep. of Germany . | |
| 2575429 | 7/1986 | France | 105/168 |

*Primary Examiner*—Margaret A. Focarino
*Assistant Examiner*—Joseph D. Pape
*Attorney, Agent, or Firm*—Kenyon & Kenyon

[57] ABSTRACT

An undercarriage with a wheel set capable of self-steering independent of the vehicle body is disclosed. The undercarriage contains, in combination with hollow profile wheels in the wheel sets and primary elastic springs in the longitudinal direction, two lever systems which are self-adjusting, independent of each other and are arranged on the longitudinal sides of an undercarriage. The lever systems forcibly couple the axle ends of the wheel sets on the same rail in the longitudinal direction of the undercarriage and are movable only in opposite directions. The levers are further provided with a reversing member tiltably supported at the truck frame, the tilting motions of which are damped by a single damper assigned to each lever system, whereby in a structurally simple, rugged and low-maintenance manner, optimum limitation of the wheel set's freedom of motion relative to the truck frame is achieved in the longitudinal frame direction with respect to radial self-adjustment in track curves and, at the same time, high stability at high speeds is achieved.

9 Claims, 2 Drawing Sheets

UNDERCARRIAGE FOR A TRACK-BOUND VEHICLE

BACKGROUND OF THE INVENTION

The invention relates to an undercarriage for a track-bound vehicle.

With the continuing increase in operational velocity, the undercarriages of modern track-bound vehicles must meet increasingly stringent requirements regarding stable running characteristics, good curve maneuverability with low horizontal force levels and low wear between the vehicle and the rail. These requirements are not met by conventional undercarriages where the individual wheel set axles are braced against the undercarriage with high longitudinal stiffness which, therefore, cannot execute the turning motions required for a radial adjustment of the wheel axle on a track curve, such as a tilting motion about the vertical axis.

For improving the maneuvering behavior of undercarriages on curves, the technique of suspending the individual wheel set axles rotatably in the undercarriage frame and adjusting the wheel sets forcibly as a function of the excursion angle of the undercarriage below the vehicle body radially to the track curve is known (see Swiss Pat. No. 183,368). Two steering linkages coupled to each other with positive motion transmission are provided for this purpose, each of which contains a reversing lever which is controlled at the vehicle body and is laterally supported at the undercarriage frame. The axle ends of the two-wheel set axles, each end overlying the same rail, are connected via a steering rod connected to the free level arm end and are adjustable in opposite directions in the longitudinal direction of the undercarriage. Such kinematic forced steering is dependent on the vehicle, body, in which the radial adjustment of the wheel set axles is derived from the relative rotation between the vehicle body and the undercarriage, and is not the subject of the present invention.

In undercarriages of the claimed type, such as cross-anchor undercarriages, the ability of automatic turning and guidance of the profiled rigid wheel set, which results on the one hand from lateral restoring forces geometrically related to the wheel/rail profile and, on the other hand, from force transmission due to slippage in the longitudinal and transverse direction, is utilized for the automatic radial adjustment of the wheel set in track curves in such a manner that the wheel set axles are guided at the undercarriage frame longitudinally elastically and are connected to each other in a self-adjusting manner with respect to their turning motions by a coupling device which is independent of the vehicle body (see DE-AS Nos. 23 56 267; 26 30 353; 26 31 350; European Pat. No. A-O, 161,729). For such a cross-anchor coupling of the respective diagonally opposite axle ends and wheel set bearings, respectively, however, the space in the center of the undercarriage which as a rule is not available in modern undercarriages, is required. Also, the lengthwise elastic axle springiness must be made so stiff for reasons of stability at higher speeds that the self-adjustment action of the wheel sets is substantially limited unless longitudinal dampers are provided in a structurally complicated manner between the undercarriage frame and the axle bearings, which then form, together with the transverse axle springiness via the undercarriage frame, a completely independent stability system. Finally, the longitudinal forces from the acceleration and deceleration of the track-bound vehicle are taken up via the longitudinal axle springs and exert a negative influence on the radial self-adjustment of the wheel sets in negotiating curves which can be avoided only by a further increase of the construction costs, namely, the incorporation of additional jointed levers which connect the wheel set axles approximately in the center of the axle to the undercarriage frame so as to transmit longitudinal forces but are free to turn.

SUMMARY OF THE INVENTION

In contrast thereto, it is an object of this invention to design an undercarriage for a track-bound vehicle in such a manner that, with a simple wheel set coupling controlled independently of the vehicle body, automatic radial adjustment of the wheel set axles in curves and, at the same time, great stability at high travel velocities can be achieved. Additionally, longitudinal forces resulting from deceleration or acceleration are transmitted from the wheel set to the undercarriage without reaction.

According to the invention, the selection and limitation of the degrees of freedom of the wheel sets in the longitudinal direction of the wheel undercarriage to that which is optimum for accurate radial adjustment in curved track and high quality stabilization action at very high travel velocities is ensured by self-adjusting lever kinematics which consists of a few simple parts which can be located without problem on the long sides of the undercarriage, leaving the center of the undercarriage free. Thus, longitudinal shifts of the wheel set axles simultaneously in the same direction are prevented by level kinematics and the longitudinal forces resulting from braking or acceleration processes are transmitted directly to the undercarriage frame via the reversing member without stressing the longitudinally elastic primary spring system. The need for an additional longitudinally stiff joint connection between the wheel set axles and the undercarriage frame is also eliminated with relation to turning motions. The wheel sets are only forcibly coupled to each other and not to the vehicle body. This limits the wheel set adjusting motions kinematically to longitudinal shifts in opposite directions of the axle ends on the same rail. Damping these longitudinal shifts requires an element which is associated with the level system for each undercarriage side. Excellent running stability is achieved in this mechanically simple manner for high speed travel, in spite of a longitudinally soft axle arrangement on the undercarriage which is sufficient for the self-adjustment action.

Due to its simple installation, rugged and low-maintenance design, the kinematic wheel set self-steering arrangement of the present invention is well suited for passenger trains as well as freight cars and for both running bogie and driving undercarriages.

In a further, particularly simple embodiment of the invention, the kinematic lever system on each undercarriage side contains only one reversal lever and two control levers connected symmetrically to the lever fulcrum which are in turn respectively flexibly connected to axle ends or axle bearings of the front and rear wheel set pairs located on the same undercarriage side. Since the primary suspension of the wheel set axles on the undercarriage frame is designed not only for longitudinal elasticity, but also for vertical resiliency, the lever kinematics preferably has a fulcrum geometry which ensures that vertical motions and the self-adjusting motions of the wheel sets take place largely uninfluenced by each other and free from reactions.

Advantageously, the two dampers are each arranged between the reversing lever and a linkage point fixed to the undercarriage so that they do not form part of the unsprung mass and, although longitudinal dampers generally have only relatively small damping distances, the characteristic of the damper can be set to the desired range in a very simple manner by the extension of the reversing lever arm, allowing special dampers of complicated design to be dispensed with. In the case of opposing self-turning motions of the wheel sets, to prevent the damper forces introduced in the linking points of the two dampers from leading to undesired interference torques about the vertical axis in the undercarriage frame, the dampers operate in a motion conforming to the diagonally opposite control levers of the two lever systems, so that despite having only a single longitudinal damper for each side of the wheel set pairs, this is sufficient for redundancy as only equidirectional damping forces symmetrical to the center of the undercarriage attached to the damper support points on the undercarriage side impinge on the dampers.

An optional arrangement which is also advantageous in view of the large adjustment distances involved and the desire to minimize the unsprung undercarriage mass of the individual dampers consists of installing the levers between the two respective control levers of each lever system. To insure that the radial self-adjustment of the wheel sets is not appreciably inhibited by damper forces, but that, at the same time, dynamic turning motion of higher frequencies of the wheel set are damped effectively, hydraulic damping elements with a steep characteristic are preferably provided as dampers.

As already mentioned, an important aspect of the invention is a coupling which permits self-adjustment of the wheel sets but limits the degree of freedom of the axles in the longitudinal direction of the undercarriage to opposing the equally large motions of axle ends in the same rail. Play in the lever system, and in particular, at its fulcrums and joints, must be avoided as far as possible. For this reason, the fulcrums and joints of the lever systems are designed preferably as wear-resistant rubber joints of very high stiffness.

BRIEF DESCRIPTION OF THE FIGURES

The invention will be explained in greater detail in the following detailed description with reference to the drawings in which.

DETAILED DESCRIPTION

Figure 1:
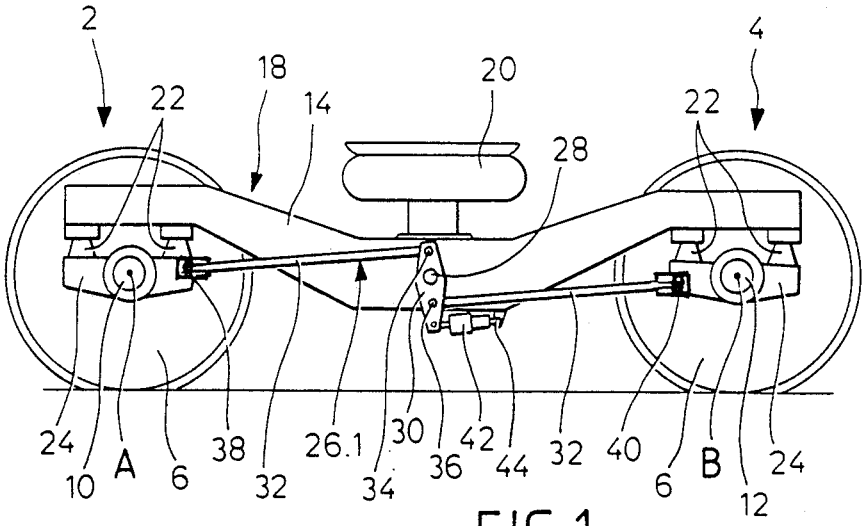
FIG. 1, a side view of a truck with a lateral lever system and associated longitudinal damping according to the present invention.

Referring to the figures, the truck contains as its main components two rigid wheel sets 2, 4, each having, respectively, wheels 6, 8, the wheels being provided with a hollow or antiwear profile and being firmly connected to wheel set shafts 10 and 12, the shafts having, respectively, axes A—A and B—B. The wheel sets are in turn connected to truck frame 18 which consists of longitudinal beams 14 and transverse beam 16 and which frame supports the vehicle body (not shown) via air springs 20 (FIGS. 1 and 2), the springs being arranged on longitudinal beams 14, and a kingpin bearing located at the center of the frame (not shown).

The primary suspension affecting the wheel set guidance of truck frame 18 comprises spring elements 22 which are elastic in all three coordinate directions, i.e., in the longitudinal, transverse and vertical directions and which spring elements couple truck frame 18 to wheel set bearing housings 24, which housings surround axles 12 and 10 on the side of the axle ends. The spring elements 22 are responsible for the radial self-adjustment of wheel sets 2 and 4 and the longitudinal elasticity of the wheel set guides.

In order to limit the freedom of motion of the two wheel sets 2 and 4 in the longitudinal direction relative to the truck frame 18, a self-adjusting lever control system is provided which consists of two lever systems 26.1 and 26.2 kinematically independent of each other and arranged respectively on one longitudinal side of the truck each. The lever systems permit only opposing longitudinal motions of the respective rail axle ends or axle bearing housings 24 of the wheel set pairs 2 and 4 relative to truck frame 18.

For this purpose, lever systems 26.1 and 26.2 contain a reversing lever 30 rotatably supported and mounted in the middle of longitudinal beam 14 by means of fulcrum 28, with two steering levers 32 extending in opposite directions therefrom. The steering levers 32 are connected at one end to joints 34 and 36, the joints 34 and 36 being located symmetrically about fulcrum 28, on the two lever arms of reversing lever 30. The other end of the steering levers are connected to the bearing housings of wheel sets 2 and 4 via joints 40 and 38. Respective pairs of levers 32 are connected to the front and rear wheels on the same side of wheel sets 2 and 4. The longitudinal freedom of lever systems 26 is responsible for the effectiveness of the wheel set self-steering and achieves this effectiveness by making joints 34, 36, 38 and 40 as wear-proof rubber joints with very high radial stiffness. Fulcrum 28 is likewise such a rubber joint or a slide bearing without play, depending on the required overall stiffness of the wheel set coupling.

It is desirable that the longitudinal or horizontal movements which are limited in their degrees of freedom by lever systems 26 and the vertical and transverse motions of the wheel sets with axes A and B which are permitted by the spring characteristics of spring elements 22, influence each other as little as possible. To that end, the straight lines connecting joints 34 and 38, 36 and 40, run, when the wheel sets 2 and 4 are in their central, neutral position, through the center line of the associated axle end which end is offset relative to the joints 38 and 40, respectively, for installation reasons, and therefore, also intersects the associated wheel set axis A and B, respectively, and, at the same time, these connecting lines on the steering lever side are essentially perpendicular to the straight line connecting joints 28, 34, 36 on reversing lever 30. This is achieved by the proper angular setting of the reversing lever 30 when the wheel sets are at the neutral position, as shown in the figures.

With each lever system 26.1 and 26.2, a damper 42 for the longitudinal motions of the wheel sets is associated. The damper is designed as a hydraulic damping element with a steep, velocity-dependent damping characteristic and is connected, according to FIGS. 1 and 3, to linking point 44 fixed to the truck and to the lever arm end of reversing lever 30, which extends beyond joint 36. In case wheel sets 2 and 4 are turned in opposite directions, truck frame 18 may perform undesirable turning motions because of the damper forces introduced to frame 18 at linking points 44 for the two dampers 42. To prevent this, the longitudinal dampers 42 work with a motion conforming to the diagonally opposite steering levers 32 of the two lever systems 26.1 and 26.2. This is achieved by the point-symmetrical arrangement of longitudinal dampers 42 with respect to the center of the truck which can be seen from FIG. 3.

Figure 2:
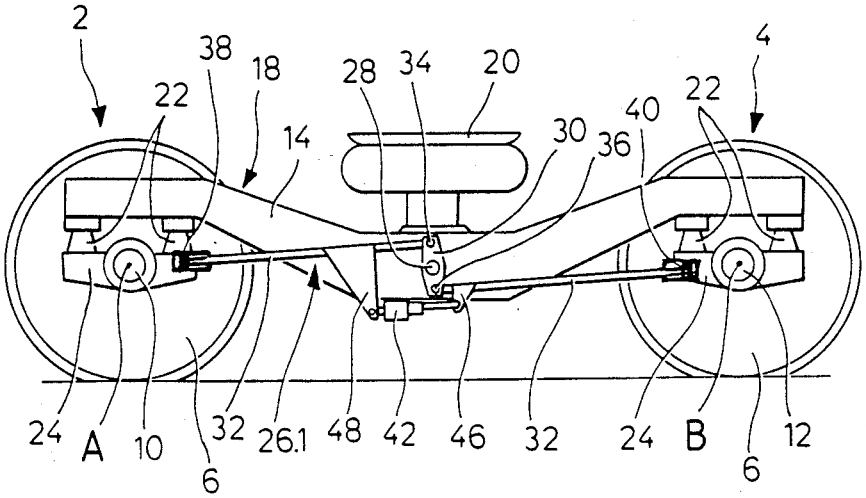
FIG. 2, a view corresponding to FIG. 1 with an alternative damper arrangement; and in FIG. 3, a perspective view of the undercarriage shown in FIG. 1.
Figure 3:
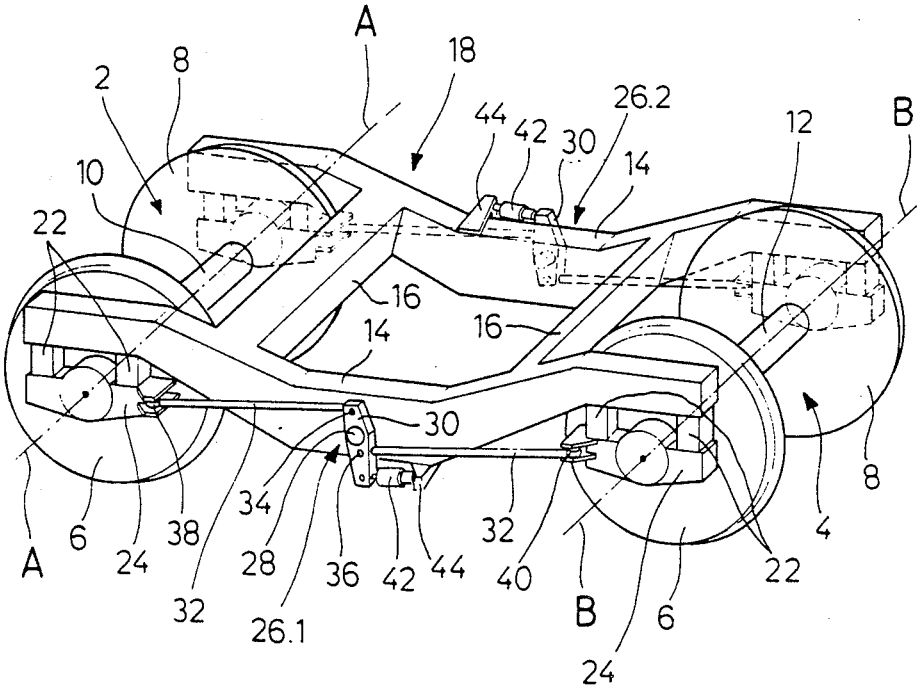

In the embodiment example shown in FIG. 2, in which parts present in FIGS. 1 and 3 have the same reference symbol, the longitudinal dampers 42 are connected by means of arms 46 and 48 to steering levers 32 of the respective lever system 26.1 and 26.2. This eliminates possible elasticity at fulcrums and joints 28, 34, and 36 on the reversing lever side and ensures a very stiff coupling of dampers 42 to wheel set bearing housing 24, whereby wheel set turning and longitudinal motions in opposite directions can be damped with the highest effectiveness. In all other respects, the design and operation of the truck shown in FIG. 2 is the same as that shown in FIGS. 1 and 3.

Longitudinal forces in the same direction from deceleration or acceleration are introduced into the truck frame 18 via steering rods 32 and the lever fulcrum 28 and have no influence on the radial adjustment of the wheel sets 2, 4 in a track curve. The described wheel set self-steering arrangement is therefore also suitable for driving undercarriages.

Instead of the rigid wheel sets 2 and 4, slippage-controlled wheel sets can also be provided which transmit an adjustable torque.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An undercarriage for a track-bound vehicle comprising:

truck frame means comprised of right and left longitudinal beams connected by forward and rear transverse beams;

a forward wheel axle with right and left forward wheels, the forward axle being mounted to the frame adjacent the forward transverse beam between the right and left longitudinal beams, the axle being rotatable and turnable;

a rear wheel axle with right and left rear wheels, the rear axle being mounted to the frame adjacent the rear transverse beam between the right and left longitudinal beams, the axle being rotatable and turnable; and right and left lever system means for converting a longitudinal shift in one wheel axle into an equal and opposite longitudinal shift in the other axle comprising right and left reversing members supported by right and left fulcrums attached respectively to the right and left longitudinal beams, the members being rotatable about the fulcrums, right and left forward and rear lever arms, the right forward lever arm coupling the right end portion of the forward axle to the right reversing member, the right rear lever arm coupling the right end portion of the rear axle to the right reversing member, the left forward lever arm coupling the left end portion of the forward axle to the left reversing member, the left rear lever arm coupling the left end portion of the rear axle to the left reversing member and right and left longitudinal dampers, the right damper being connected between the right reversing member and the right longitudinal beam or between the right forward and rear lever arms, and the left damper being connected between the left reversing member and the left longitudinal beam or between the left forward and rear lever arms, said dampers being provided to dampen oscillations in said right and left lever system means, said right and left lever systems each being adjustable independently of each other.

2. The undercarriage of claim 1 wherein the right and left reversing members comprise a reversing lever with two lever arms, the arms being diametrically opposite to one another with respect to the fulcrum.

3. The undercarriage of claim 2 wherein, when all wheels are parallel to the longitudinal beams, lines drawn from the point where the right and left forward lever arms are coupled to the right and left forward axle to the point where the right and left forward lever arms are coupled to the right and left reversing levers would intersect the line extended through the forward wheel axle, lines drawn from the point where the right and left rear lever arms are coupled to the right and left rear axle to the point where the right and left rear lever arms are coupled to the right and left reversing levers would intersect the line extended through the rear wheel axle and the right and left reversing levers are perpendicular to the lever arms.

4. The undercarriage of claim 2 wherein the right and left dampers are coupled to linking points fixed to the longitudinal beams and to the right and left reversing levers.

5. The undercarriage of claim 4 wherein one arm of the right and left reversing levers is extended beyond where the reversing lever is coupled to the lever arms and the dampers are coupled to the extended lever arm.

6. The undercarriage of claim 4 wherein the dampers respond independently of one another to motions of the right and left forward and rear lever arms.

7. The undercarriage of claim 2 wherein one end of the dampers is coupled to the forward lever arms and the other end of the damper is coupled to the rear lever arms.

8. The undercarriage of claim 1 wherein the damper is a hydraulic damping element with a steep velocity-dependent damping characteristic.

9. The undercarriage of claim 1 wherein the couplings between the fulcrums and reversing members, the reversing members and the lever arms, and the lever arms and the axles comprise wear-proof rubber joints with a very high stiffness.

* * * * *